US010702879B2

(12) United States Patent
Gehrung

(10) Patent No.: US 10,702,879 B2
(45) Date of Patent: Jul. 7, 2020

(54) SPRAY GUN MANUFACTURING METHOD, SPRAY GUN, SPRAY GUN BODY AND COVER

(71) Applicant: SATA GmbH & Co. KG, Kornwestheim (DE)

(72) Inventor: Ralf Gehrung, Stuttgart (DE)

(73) Assignee: SATA GmbH & Co. KG, Kornwestheim (DE)

( * ) Notice: Subject to any disclaimer, the term of this patent is extended or adjusted under 35 U.S.C. 154(b) by 113 days.

(21) Appl. No.: 14/815,210

(22) Filed: Jul. 31, 2015

(65) Prior Publication Data

US 2016/0030960 A1 Feb. 4, 2016

(30) Foreign Application Priority Data

Jul. 31, 2014 (CN) ..... 2014 1 0374583

(51) Int. Cl.

| | |
|---|---|
| ***B05B 12/00*** | (2018.01) |
| ***B05B 15/63*** | (2018.01) |
| ***B05B 7/02*** | (2006.01) |
| ***B05B 7/24*** | (2006.01) |

(52) U.S. Cl.

CPC ..... *B05B 12/008* (2013.01); *B05B 7/02* (2013.01); *B05B 15/63* (2018.02); *B05B 7/2478* (2013.01)

(58) Field of Classification Search

CPC ..... B05B 7/02–129; B05B 12/008; B05B 11/0005; B05B 15/00; B05B 12/004; B05B 12/006; B05B 15/60; B05B 15/63; B05B 9/01

USPC ..... 239/71, 526

See application file for complete search history.

(56) References Cited

U.S. PATENT DOCUMENTS

| | | | |
|---|---|---|---|
| 40,433 | A | 10/1863 | Sees |
| 327,260 | A | 9/1885 | Hart |
| 459,432 | A | 9/1891 | Anderson |
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |
| 581,107 | A | 4/1897 | Emery |
| 644,803 | A | 3/1900 | Justi |
| 672,012 | A | 4/1901 | Ruper |

(Continued)

FOREIGN PATENT DOCUMENTS

| | | |
|---|---|---|
| AT | 153883 | 6/1997 |
| AT | 163577 | 3/1998 |

(Continued)

OTHER PUBLICATIONS

Office Action dated Feb. 19, 2016 for U.S. Appl. No. 14/113,649.

(Continued)

*Primary Examiner* — Cody J Lieuwen

(74) *Attorney, Agent, or Firm* — Paul D. Bianco; Gary Winer; Fleit Intellectual Property Law

(57) ABSTRACT

A spray gun manufacturing method, a spray gun, a spray gun body and a cover. The method includes forming a spray gun body. In forming the spray gun body, a bearing part is formed on a side of the spray gun body, with a surface of the bearing part being lower than another surface of the side of the spray gun body, and a partial edge of the bearing part corresponding to a partial edge of the spray gun body.

13 Claims, 8 Drawing Sheets

(56) References Cited

U.S. PATENT DOCUMENTS

| | | | |
|---|---|---|---|
| 574,880 | A | 5/1901 | Schmidt et al. |
| 1,662,496 | A | 3/1928 | Forsgard |
| 1,703,383 | A | 2/1929 | Birkenmaier |
| 1,703,384 | A | 2/1929 | Birkenmaier |
| 1,711,221 | A | 4/1929 | Blakeslee |
| 1,751,787 | A | 3/1930 | Binks |
| 1,889,201 | A | 11/1932 | Holveck |
| 2,004,303 | A | 6/1935 | Wahlin |
| 2,008,381 | A | 7/1935 | Beeg |
| 2,049,700 | A | 8/1936 | Gustafsson |
| 2,051,210 | A | 8/1936 | Gustafsson |
| 2,070,696 | A | 2/1937 | Tracy |
| 2,116,036 | A | 5/1938 | Money |
| 2,125,445 | A | 8/1938 | Holveck |
| 2,198,441 | A | 4/1940 | Lobegott |
| 2,204,599 | A | 6/1940 | Jenkins |
| 2,269,057 | A | 1/1942 | Jenkins |
| D133,223 | S | 7/1942 | Tammen |
| 2,356,865 | A | 8/1944 | Mason |
| 2,416,856 | A | 3/1947 | Thomsen |
| 2,416,923 | A | 3/1947 | Jenkins |
| 2,557,593 | A | 6/1951 | Bjorkman |
| 2,557,606 | A | 6/1951 | Liedberg |
| 2,559,091 | A | 7/1951 | Reasenberg |
| 2,609,961 | A | 9/1952 | Sapien |
| 2,612,899 | A | 10/1952 | Webb |
| 2,646,314 | A | 7/1953 | Peeps |
| 2,721,004 | A | 10/1955 | Schultz |
| 2,743,963 | A | 5/1956 | Peeps |
| 2,844,267 | A | 7/1958 | Petriccione |
| 2,886,252 | A | 5/1959 | Ehrensperger |
| 3,090,530 | A | 5/1963 | Peeps |
| D196,477 | S | 10/1963 | Kelly |
| 3,159,472 | A | 12/1964 | Revell |
| D200,594 | S | 3/1965 | Sass |
| 3,240,398 | A | 3/1966 | Dalton, Jr. |
| D204,306 | S | 4/1966 | Hamm |
| D205,760 | S | 9/1966 | Hocutt et al. |
| D208,903 | S | 10/1967 | Zadron et al. |
| 3,344,992 | A | 10/1967 | Norris |
| 3,381,845 | A | 5/1968 | MacDonald |
| 3,417,650 | A | 12/1968 | Varrin |
| 3,420,106 | A | 1/1969 | Keller et al. |
| 3,435,683 | A | 4/1969 | Keller et al. |
| 3,482,781 | A | 12/1969 | Sharpe |
| D217,928 | S | 6/1970 | Felske |
| 3,524,589 | A | 8/1970 | Pelton, Jr. |
| 3,527,372 | A | 9/1970 | Manning |
| 3,583,632 | A | 6/1971 | Schaffer |
| 3,622,078 | A | 11/1971 | Gronert |
| 3,645,562 | A | 2/1972 | Fandetti et al. |
| 3,656,493 | A | 4/1972 | Black et al. |
| 3,714,967 | A | 2/1973 | Zupan et al. |
| 3,746,253 | A | 7/1973 | Walberg |
| 3,747,850 | A | 7/1973 | Hastings et al. |
| 3,771,539 | A | 11/1973 | De Santis |
| 3,840,143 | A | 10/1974 | Davis et al. |
| 3,848,807 | A | 11/1974 | Partida |
| 3,857,511 | A | 12/1974 | Govindan |
| 3,870,223 | A | 3/1975 | Wyant |
| 3,873,023 | A | 3/1975 | Moss et al. |
| 3,938,739 | A | 2/1976 | Bertilsson et al. |
| 4,000,915 | A | 1/1977 | Strom |
| D245,048 | S | 7/1977 | Pool |
| D252,097 | S | 6/1979 | Probst et al. |
| 4,160,525 | A | 7/1979 | Wagner |
| 4,171,091 | A | 10/1979 | van Hardeveld et al. |
| 4,210,263 | A | 7/1980 | Bos |
| 4,273,293 | A | 6/1981 | Hastings |
| 4,278,276 | A | 7/1981 | Ekman |
| 4,411,387 | A | 10/1983 | Stern et al. |
| 4,478,370 | A | 10/1984 | Hastings |
| D276,472 | S | 11/1984 | Harrison |
| D278,543 | S | 4/1985 | Gintz |
| 4,545,536 | A | 10/1985 | Avidon |
| 4,562,965 | A | 1/1986 | Ihmels et al. |
| 4,572,437 | A | 2/1986 | Huber et al. |
| 4,580,035 | A | 4/1986 | Luscher |
| 4,585,168 | A | 4/1986 | Even et al. |
| 4,614,300 | A | 9/1986 | Falcoff |
| 4,643,330 | A | 2/1987 | Kennedy |
| 4,653,661 | A | 3/1987 | Buchner et al. |
| 4,667,878 | A | 5/1987 | Behr |
| 4,713,257 | A | 12/1987 | Luttermoeller |
| D293,950 | S | 1/1988 | Ogden et al. |
| 4,730,753 | A | 3/1988 | Grime |
| 4,767,057 | A | 8/1988 | Degli et al. |
| D298,372 | S | 11/1988 | Taylor, Jr. |
| 4,784,184 | A | 11/1988 | Gates |
| 4,806,736 | A | 2/1989 | Schirico |
| 4,826,539 | A | 5/1989 | Harpold |
| 4,832,232 | A | 5/1989 | Broccoli |
| 4,863,781 | A | 9/1989 | Kronzer |
| 4,877,144 | A | 10/1989 | Thanisch |
| D305,057 | S | 12/1989 | Morgan |
| 4,887,747 | A | 12/1989 | Ostrowsky et al. |
| 4,901,761 | A | 2/1990 | Taylor |
| 4,906,151 | A | 3/1990 | Kubis |
| 4,917,300 | A | 4/1990 | Gloviak et al. |
| 4,946,075 | A | 8/1990 | Lundback |
| 4,964,361 | A | 10/1990 | Aebersold |
| 4,967,600 | A | 11/1990 | Keller |
| 4,969,603 | A | 11/1990 | Norman |
| 4,973,184 | A | 11/1990 | La Salle |
| D314,421 | S | 2/1991 | Tajima et al. |
| D314,588 | S | 2/1991 | Denham |
| 4,989,787 | A | 2/1991 | Nikkel et al. |
| 5,020,700 | A | 6/1991 | Krzywdziak et al. |
| D318,877 | S | 8/1991 | Miranda et al. |
| 5,042,840 | A | 8/1991 | Rieple et al. |
| D321,597 | S | 11/1991 | Cerny |
| 5,064,119 | A | 11/1991 | Mellette |
| 5,071,074 | A | 12/1991 | Lind |
| 5,074,334 | A | 12/1991 | Onodera |
| 5,078,323 | A | 1/1992 | Frank |
| 5,080,285 | A | 1/1992 | Toth |
| 5,088,648 | A | 2/1992 | Schmon |
| 5,090,623 | A | 2/1992 | Burns et al. |
| 5,102,045 | A | 4/1992 | Diana |
| 5,119,992 | A | 6/1992 | Grime |
| 5,125,391 | A | 6/1992 | Srivastava et al. |
| 5,135,124 | A | 8/1992 | Wobser |
| 5,143,102 | A | 9/1992 | Blaul |
| 5,165,605 | A | 11/1992 | Morita et al. |
| 5,170,941 | A | 12/1992 | Morita et al. |
| 5,190,219 | A | 3/1993 | Copp, Jr. |
| 5,191,797 | A | 3/1993 | Smith |
| 5,209,405 | A | 5/1993 | Robinson et al. |
| 5,228,488 | A | 7/1993 | Fletcher |
| 5,232,299 | A | 8/1993 | Hiss |
| 5,236,128 | A | 8/1993 | Morita et al. |
| 5,249,746 | A | 10/1993 | Kaneko et al. |
| D341,186 | S | 11/1993 | Albers |
| 5,289,974 | A | 3/1994 | Grime et al. |
| 5,322,221 | A | 6/1994 | Anderson |
| 5,325,473 | A | 6/1994 | Monroe et al. |
| 5,332,156 | A | 7/1994 | Wheeler |
| 5,333,506 | A | 8/1994 | Smith et al. |
| 5,333,908 | A | 8/1994 | Dorney et al. |
| 5,344,078 | A | 9/1994 | Fritz et al. |
| 5,367,148 | A | 11/1994 | Storch et al. |
| D353,836 | S | 12/1994 | Carvelli et al. |
| 5,381,962 | A | 1/1995 | Teague |
| 5,435,491 | A | 7/1995 | Sakuma |
| 5,443,642 | A | 8/1995 | Bienduga |
| 5,456,414 | A | 10/1995 | Burns et al. |
| D365,952 | S | 1/1996 | Gagnon et al. |
| 5,503,439 | A | 4/1996 | LaJeunesse et al. |
| 5,529,245 | A | 6/1996 | Brown |
| 5,533,674 | A | 7/1996 | Feyrer et al. |
| 5,540,385 | A | 7/1996 | Garlick |
| 5,540,386 | A | 7/1996 | Roman |
| D376,637 | S | 12/1996 | Kieffer |
| 5,582,350 | A | 12/1996 | Kosmyna et al. |

(56) References Cited

U.S. PATENT DOCUMENTS 5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,667,143 A 9/1997 Sebion et al.
5,695,125 A 12/1997 Kumar
5,704,381 A 1/1998 Millan et al.
5,718,767 A 2/1998 Crum et al.
D391,403 S 3/1998 Josephs
5,725,161 A 3/1998 Hartle
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson et al.
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,230,986 B1 5/2001 Vacher et al.
6,250,567 B1 6/2001 Lewis et al.
6,267,301 B1 7/2001 Haruch
6,276,616 B1 8/2001 Jenkins
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,612,506 B1 9/2003 Huang
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 4/2006 Blette et al.
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
D588,231 S 3/2009 Pellin

(56) References Cited

U.S. PATENT DOCUMENTS 7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,856,940 B2 12/2010 Wendler
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,492 S 6/2012 Ranschau
D661,742 S 6/2012 Clark
D663,960 S 7/2012 Jeronimo
8,225,892 B2 7/2012 Ben-Tzvi
D664,773 S 8/2012 Papin
8,240,579 B1 8/2012 Bennett
8,297,536 B2 10/2012 Ruda
D670,085 S 11/2012 Brookman et al.
D671,988 S 12/2012 Leipold
D672,012 S 12/2012 Brose
D674,880 S 1/2013 Schmon
8,352,744 B2 1/2013 Kruse
8,360,345 B2 1/2013 Micheli
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
D692,532 S 10/2013 Li et al.
8,616,434 B2 12/2013 Wilen
D697,584 S 1/2014 Schmon
D698,008 S 1/2014 Schmon et al.
8,626,674 B2 1/2014 Whitehouse
8,642,131 B2 2/2014 Nolte et al.
D704,300 S 5/2014 Li et al.
8,757,182 B2 6/2014 Schmon
8,807,460 B2 8/2014 Charpie et al.
8,857,732 B2 10/2014 Brose
D720,015 S 12/2014 Kruse
D720,041 S 12/2014 Robinson
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,428 S 7/2015 Wang
D734,429 S 7/2015 Wang
D734,571 S 7/2015 Tschan
9,073,068 B2 7/2015 Krayer et al.
D737,126 S 8/2015 Tschan
D740,393 S 10/2015 Gehrung
D745,636 S 12/2015 Lin
9,220,853 B2 12/2015 Vogt
D757,216 S 5/2016 Gherung
D758,533 S 6/2016 Dettlaff
D758,537 S 6/2016 Gehrung
D768,820 S 10/2016 Binz
D770,593 S 11/2016 Gehrung
9,533,317 B2 1/2017 Gehrung et al.
D792,557 S 7/2017 Wang
D794,756 S 8/2017 Wang
9,782,784 B2 10/2017 Schmon et al.
9,878,336 B2 1/2018 Gehrung
D835,235 S 12/2018 Gehrung et al.
10,189,037 B2 1/2019 Schmon et al.
10,471,449 B2 11/2019 Gehrung
2001/0004996 A1 6/2001 Schmon
2001/0040192 A1 11/2001 Kaneko et al.
2002/0134861 A1 9/2002 Petrie et al.
2002/0148501 A1 10/2002 Shieh
2002/0170978 A1 11/2002 Mohn
2003/0025000 A1* 2/2003 Schmon ..... B05B 12/008 239/296
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0173419 A1 9/2003 Huang
2003/0177979 A1 9/2003 Crum et al.
2003/0189105 A1* 10/2003 Schmon ..... B05B 12/008 239/291
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0050432 A1 3/2004 Breda
2004/0104194 A1 6/2004 Dennison
2004/0129738 A1 7/2004 Stukas
2004/0140373 A1 7/2004 Joseph et al.
2004/0155063 A1 8/2004 Hofeldt
2004/0159720 A1 8/2004 Komornicki
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1* 6/2005 Matsumoto ..... B05B 7/02 239/71
2005/0145723 A1 7/2005 Blette et al.
2005/0145724 A1 7/2005 Blette et al.
2005/0178854 A1 8/2005 Dodd
2005/0189445 A1 9/2005 Hartle et al.
2005/0218246 A1 10/2005 Chatron et al.
2005/0220943 A1 10/2005 Abrams et al.
2005/0248148 A1 11/2005 Schenck et al.
2005/0252993 A1 11/2005 Rogers
2005/0252994 A1 11/2005 Rogers
2005/0268949 A1 12/2005 Rosa
2005/0284963 A1 12/2005 Reedy
2006/0000927 A1 1/2006 Ruda
2006/0007123 A1 1/2006 Wilson et al.
2006/0048803 A1 3/2006 Jessup et al.
2006/0081060 A1 4/2006 Forster
2006/0113409 A1 6/2006 Camilleri et al.
2006/0171771 A1 8/2006 Kruse
2006/0192377 A1 8/2006 Bauer et al.
2006/0196891 A1 9/2006 Gerson et al.
2007/0029788 A1 2/2007 Adler

(56) References Cited

U.S. PATENT DOCUMENTS

| | | | | |
|---|---|---|---|---|
| 2007/0055883 | A1 | 3/2007 | Kruse | |
| 2007/0131795 | A1 | 6/2007 | Abbate et al. | |
| 2007/0158349 | A1 | 7/2007 | Schmon et al. | |
| 2007/0205305 | A1 | 9/2007 | Vagedes | |
| 2007/0221754 | A1 | 9/2007 | Gehrung | |
| 2007/0252378 | A1 | 11/2007 | Chambers | |
| 2007/0262169 | A1 | 11/2007 | Wang | |
| 2008/0011879 | A1 | 1/2008 | Gerson et al. | |
| 2008/0019789 | A1 | 1/2008 | Dunaway et al. | |
| 2008/0029619 | A1 | 2/2008 | Gohring et al. | |
| 2008/0128533 | A1 | 6/2008 | Gehrung | |
| 2008/0179763 | A1 | 7/2008 | Schmon et al. | |
| 2008/0251977 | A1 | 10/2008 | Naruse et al. | |
| 2008/0264892 | A1 | 10/2008 | Nozawa | |
| 2008/0272213 | A1 | 11/2008 | Ting | |
| 2008/0296410 | A1 | 12/2008 | Carey et al. | |
| 2009/0014557 | A1 | 1/2009 | Schmon et al. | |
| 2009/0026290 | A1 | 1/2009 | Fox | |
| 2009/0045623 | A1 | 2/2009 | Schmon | |
| 2009/0072050 | A1 | 3/2009 | Ruda | |
| 2009/0078789 | A1 | 3/2009 | Kruse | |
| 2009/0078790 | A1 | 3/2009 | Camilleri et al. | |
| 2009/0143745 | A1 | 6/2009 | Langan et al. | |
| 2009/0183516 | A1 | 7/2009 | Appler et al. | |
| 2009/0235864 | A1 | 9/2009 | Khoury et al. | |
| 2009/0266915 | A1 | 10/2009 | Fedorov | |
| 2010/0021646 | A1 | 1/2010 | Nolte et al. | |
| 2010/0059533 | A1 | 3/2010 | Unger et al. | |
| 2010/0084493 | A1 | 4/2010 | Troudt | |
| 2010/0108783 | A1 | 5/2010 | Joseph et al. | |
| 2010/0126541 | A1 | 5/2010 | Schmon | |
| 2010/0163649 | A1 | 7/2010 | Bass et al. | |
| 2010/0206963 | A1 | 8/2010 | Huang | |
| 2010/0270390 | A1 | 10/2010 | Reitz | |
| 2010/0270400 | A1* | 10/2010 | Evar | B05B 7/0408 239/414 |
| 2011/0024524 | A1 | 2/2011 | Fox | |
| 2011/0121103 | A1 | 5/2011 | Carleton et al. | |
| 2011/0125607 | A1 | 5/2011 | Wilen | |
| 2011/0127767 | A1 | 6/2011 | Wicks et al. | |
| 2011/0168811 | A1 | 7/2011 | Fox et al. | |
| 2011/0174901 | A1 | 7/2011 | Dettlaff et al. | |
| 2012/0012671 | A1 | 1/2012 | Brose et al. | |
| 2012/0097762 | A1 | 4/2012 | Gehrung et al. | |
| 2012/0132550 | A1 | 5/2012 | Gerson et al. | |
| 2012/0160935 | A1 | 6/2012 | Krayer et al. | |
| 2012/0187220 | A1 | 7/2012 | Micheli et al. | |
| 2013/0056556 | A1 | 3/2013 | Schmon et al. | |
| 2013/0074864 | A1 | 3/2013 | Nuzzo et al. | |
| 2013/0266734 | A1 | 10/2013 | Nolte et al. | |
| 2013/0320110 | A1 | 12/2013 | Brose et al. | |
| 2014/0034757 | A1 | 2/2014 | Kaneko et al. | |
| 2014/0048627 | A1 | 2/2014 | Schmon et al. | |
| 2014/0059905 | A1 | 3/2014 | Raming | |
| 2014/0145003 | A1 | 5/2014 | Schmon et al. | |
| 2014/0263686 | A1* | 9/2014 | Hedger | B29B 7/7438 239/1 |
| 2014/0305962 | A1 | 10/2014 | Tschan | |
| 2015/0165463 | A1 | 6/2015 | Gehrung | |
| 2015/0231655 | A1 | 8/2015 | Adams et al. | |
| 2017/0304852 | A1 | 10/2017 | Bierie | |
| 2018/0050355 | A1 | 2/2018 | Delsard | |
| 2018/0050356 | A1 | 2/2018 | Gehrung | |
| 2018/0050361 | A1 | 2/2018 | Gehrung | |
| 2018/0050362 | A1 | 2/2018 | Gehrung et al. | |
| 2018/0133727 | A1 | 5/2018 | Schmon et al. | |
| 2018/0200740 | A1 | 7/2018 | Rossbach et al. | |
| 2020/0038889 | A1 | 2/2020 | Volk et al. | |
| 2020/0038892 | A1 | 2/2020 | Volk et al. | |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1899704 | A | 1/2007 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 201064746 | Y | 5/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102139249 | A | 8/2011 |
| CN | 102211069 | | 10/2011 |
| CN | 103 521 378 | A | 1/2014 |
| CN | 203508251 | U | 4/2014 |
| CN | 203737474 | U | 7/2014 |
| CN | 204074345 | U | 1/2015 |
| CN | 204294401 | U | 4/2015 |
| CN | 205966208 | U | 2/2017 |
| CN | 107427851 | A | 12/2017 |
| CN | 108223901 | A | 6/2018 |
| DE | 460381 | | 5/1928 |
| DE | 510362 | | 10/1930 |
| DE | 611325 | C | 3/1935 |
| DE | 1425890 | | 11/1968 |
| DE | 2559036 | | 9/1976 |
| DE | 2653981 | | 6/1978 |
| DE | 2950341 | | 7/1980 |
| DE | 2926286 | A1 | 1/1981 |
| DE | 3016419 | | 11/1981 |
| DE | 8024829.9 | | 9/1982 |
| DE | 3111571 | A1 | 10/1982 |
| DE | 3238149 | A1 | 4/1984 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | G 94 16 015.5 | U1 | 11/1994 |
| DE | 4321940 | | 1/1995 |
| DE | 69211891 | T2 | 10/1996 |

(56) References Cited

FOREIGN PATENT DOCUMENTS

| | | | | |
|---|---|---|---|---|
| DE | 19516485 | | 11/1996 | |
| DE | 19727884 | | 2/1999 | |
| DE | 69505433 | T2 | 4/1999 | |
| DE | 19807973 | | 7/1999 | |
| DE | 19824264 | | 12/1999 | |
| DE | 19832990 | | 1/2000 | |
| DE | 20000483 | | 8/2000 | |
| DE | 10004105 | | 10/2000 | |
| DE | 19958569 | | 2/2001 | |
| DE | 199 41 362 | | 3/2001 | |
| DE | 199 45 760 | | 3/2001 | |
| DE | 19945760 | | 3/2001 | |
| DE | 10103221 | A1 | 8/2001 | |
| DE | 10031857 | | 1/2002 | |
| DE | 10031858 | | 1/2002 | |
| DE | 20114257 | | 2/2002 | |
| DE | 10059406 | | 6/2002 | |
| DE | 10135104 | | 9/2002 | |
| DE | 102 05 831 | | 8/2003 | |
| DE | 10205831 | | 8/2003 | |
| DE | 10311238 | | 10/2004 | |
| DE | 10 2004 027 789 | | 2/2005 | |
| DE | 29825120 | | 2/2005 | |
| DE | 102004027789 | A1 | 2/2005 | |
| DE | 69827994 | T2 | 4/2005 | |
| DE | 20320781 | | 6/2005 | |
| DE | 10 2004 014 646 | | 7/2005 | |
| DE | 10 2004 003 438 | | 8/2005 | |
| DE | 102004003439 | | 8/2005 | |
| DE | 10 2004 007 733 | | 9/2005 | |
| DE | 10 2004 021 298 | | 11/2005 | |
| DE | 699 28 944 | T2 | 9/2006 | |
| DE | 69535077 | T2 | 11/2006 | |
| DE | 202007001031 | | 3/2007 | |
| DE | 60200500 1173 | | 8/2007 | |
| DE | 60206956 | T2 | 8/2008 | |
| DE | 102007006547 | | 8/2008 | |
| DE | 102007013628 | A1 | 9/2008 | |
| DE | 102007039106 | | 2/2009 | |
| DE | 102007052067 | | 5/2009 | |
| DE | 20 2010 012 449 | U1 | 12/2010 | |
| DE | 202010012449 | | 12/2010 | |
| DE | 102009032399 | A1 | 1/2011 | |
| DE | 102009053449 | | 2/2011 | |
| DE | 102010060086 | | 4/2012 | |
| DE | 102010056263 | A1 | 6/2012 | |
| DE | 102011106060 | | 1/2013 | |
| DE | 102011118120 | | 5/2013 | |
| DE | 10 2011 120 717 | A1 | 6/2013 | |
| DE | 112007001824 | B3 | 7/2013 | |
| DE | 10 2012 013 464 | A1 | 11/2013 | |
| DE | 10 2015 114202 | A1 | 1/2017 | |
| EM | 002066910-0001 | | 3/2013 | |
| EM | 002066910-0002 | | 3/2013 | |
| EM | 002066910-0003 | | 3/2013 | |
| EM | 002066910-0004 | | 3/2013 | |
| EM | 002066910-0005 | | 3/2013 | |
| EM | 002066910-0006 | | 3/2013 | |
| EM | 002066910-0007 | | 3/2013 | |
| EM | 002066910-0008 | | 3/2013 | |
| EM | 002066910-0009 | | 3/2013 | |
| EM | 002066910-0010 | | 3/2013 | |
| EP | 0092043 | A2 | 10/1983 | |
| EP | 0092392 | | 10/1983 | |
| EP | 0114064 | A2 | 7/1984 | |
| EP | 0313958 | A2 | 5/1989 | |
| EP | 524408 | | 1/1993 | |
| EP | 567325 | | 10/1993 | |
| EP | 0631821 | | 1/1995 | |
| EP | 0650766 | | 5/1995 | |
| EP | 0650766 | A2 | 5/1995 | |
| EP | 678334 | | 10/1995 | |
| EP | 0706832 | | 4/1996 | |
| EP | 0706832 | A1 | 4/1996 | |
| EP | 0710506 | | 5/1996 | |
| EP | 801002 | | 10/1997 | |
| EP | 0846498 | A1 | 6/1998 | |
| EP | 987060 | | 3/2000 | |
| EP | 1081639 | | 3/2001 | |
| EP | 1106262 | | 6/2001 | |
| EP | 1247586 | | 10/2002 | |
| EP | 1247586 | A1 * | 10/2002 | ..... B05B 7/02 |
| EP | 1277519 | | 1/2003 | |
| EP | 1294490 | | 3/2003 | |
| EP | 1299194 | | 4/2003 | |
| EP | 1366823 | | 12/2003 | |
| EP | 1412669 | | 4/2004 | |
| EP | 1424135 | | 6/2004 | |
| EP | 1477232 | A1 | 11/2004 | |
| EP | 1479447 | A1 | 11/2004 | |
| EP | 1504823 | A1 | 2/2005 | |
| EP | 1563913 | | 8/2005 | |
| EP | 1574262 | | 9/2005 | |
| EP | 1602412 | | 12/2005 | |
| EP | 1658902 | A1 | 5/2006 | |
| EP | 1708822 | | 10/2006 | |
| EP | 1708823 | | 10/2006 | |
| EP | 1718415 | | 11/2006 | |
| EP | 1880771 | A1 | 1/2008 | |
| EP | 1902766 | A1 | 3/2008 | |
| EP | 1902786 | | 3/2008 | |
| EP | 1902876 | | 3/2008 | |
| EP | 1930084 | | 6/2008 | |
| EP | 1964616 | | 9/2008 | |
| EP | 1964616 | A2 | 9/2008 | |
| EP | 1997561 | A2 | 12/2008 | |
| EP | 2017010 | A2 | 1/2009 | |
| EP | 2027931 | | 2/2009 | |
| EP | 2092987 | A1 | 8/2009 | |
| EP | 2106298 | | 10/2009 | |
| EP | 2111920 | | 10/2009 | |
| EP | 2451586 | A1 | 5/2012 | |
| EP | 2490819 | | 8/2012 | |
| EP | 2576079 | | 4/2013 | |
| EP | 2608890 | | 7/2013 | |
| EP | 2 669 213 | A1 | 12/2013 | |
| EP | 2703089 | A1 | 3/2014 | |
| EP | 2 828 000 | A1 | 1/2015 | |
| FR | 398333 | | 6/1909 | |
| FR | 789762 | | 11/1935 | |
| FR | 1410519 | | 9/1964 | |
| FR | 2444501 | | 7/1980 | |
| FR | 2462200 | A1 | 2/1981 | |
| FR | 2 570 140 | | 3/1986 | |
| FR | 2 774 928 | | 8/1999 | |
| FR | 2863512 | A1 | 6/2005 | |
| FR | 2927824 | A1 | 8/2009 | |
| GB | 190900523 | | 6/1909 | |
| GB | 657854 | A | 9/1951 | |
| GB | 2 132 916 | | 7/1984 | |
| GB | 2153260 | | 8/1985 | |
| GB | 2372465 | | 8/2002 | |
| GB | 2411235 | | 8/2005 | |
| HK | 1100405 | | 6/2009 | |
| HK | 1096057 | | 7/2009 | |
| HK | 1125067 | | 8/2012 | |
| HK | 1138533 | | 11/2012 | |
| JP | S49-136868 | U | 11/1974 | |
| JP | S55-107258 | U | 7/1980 | |
| JP | S5654328 | | 5/1981 | |
| JP | S57-75246 | | 5/1982 | |
| JP | S57128346 | A | 8/1982 | |
| JP | 58-119862 | | 5/1983 | |
| JP | S5998757 | | 6/1984 | |
| JP | S601722 | | 1/1985 | |
| JP | S62160156 | A | 7/1987 | |
| JP | H01-87805 | | 6/1989 | |
| JP | H02258076 | A | 10/1990 | |
| JP | H04-176352 | A | 6/1992 | |
| JP | H0530749 | | 4/1993 | |
| JP | H05172678 | | 7/1993 | |
| JP | 674850 | | 3/1994 | |
| JP | H06215741 | | 8/1994 | |
| JP | H07204542 | A | 8/1995 | |

(56) References Cited

FOREIGN PATENT DOCUMENTS

| | | | |
|---|---|---|---|
| JP | H08196950 | | 8/1996 |
| JP | H08196950 | A | 8/1996 |
| JP | H09117697 | | 5/1997 |
| JP | 11-047643 | A | 2/1999 |
| JP | 2001259487 | | 9/2001 |
| JP | 2003042882 | | 2/2002 |
| JP | 2003088780 | | 3/2003 |
| JP | 2004-501763 | A | 1/2004 |
| JP | 2004017044 | | 1/2004 |
| JP | 2005138885 | | 6/2005 |
| JP | 2007516831 | | 6/2007 |
| JP | 2008018296 | A | 1/2008 |
| JP | 2010-528837 | A | 8/2010 |
| JP | 2014124274 | A | 7/2014 |
| KR | 20140064644 | A | 5/2014 |
| RU | 2523816 | C1 | 1/2014 |
| TW | 491092 | | 6/2002 |
| TW | 510253 | U | 11/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |
| WO | 2013/131626 | A1 | 9/2013 |
| WO | 2013/142045 | A1 | 9/2013 |

OTHER PUBLICATIONS

Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
Office Action dated Aug. 7, 2015 for U.S. Appl. No. 13/991,285.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
International Preliminary Report on Patentability for PCT/EP2015/001728 filed Aug. 25, 2015.
Final Office Action dated Mar. 16, 2017 from U.S. Appl. No. 13/698,417, 9 pages.
Response to Final Office Action and RCE dated Nov. 29, 2016 in U.S. Appl. No. 14/113,649.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Response filed Dec. 21, 2015 to Office Action dated Jul. 20, 2015 for U.S. Appl. No. 14/113,649.
Notice of Allowance dated Jan. 27, 2016 for Design U.S. Appl. No. 29/510,723.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued agains JP Patent App. 2012-508926 dated Feb. 25, 2014 with English translation.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
Response to Restriction Requirement filed Jul. 27, 2015 to Restriction Requirement dated May 27, 2015 for U.S. Appl.No. 13/991,285.
Notice of Allowance dated Aug. 3, 2015 for U.S. Appl. No. 29/486,232.

(56) References Cited

OTHER PUBLICATIONS

Final Office Action dated Aug. 4, 2015 for U.S. Appl. No. 13/380,949.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf> (cited in OA for paint spray gun cleaning device).
Jetclean GUn Cleaner Terry's Auto Supply, google publish date Aug. 4, 2011, [online], [site visited Jan. 7, 2015], <http://secure.terrys.net/viewProduct.php?productID=FT.FHAZ1005>.
Restriction Requirement dated Feb. 6, 2015 for Design U.S. Appl. No. 29/486,232.
Office Action dated Mar. 30, 2015 for U.S. Appl. No. 13/698,417.
Responde to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dated Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No.29/516,082.
Application filed Mar. 3, 2015, 2015 for Design U.S. Appl. No. 29/519,198.
Final Office Action dated Jul. 20, 2015 for U.S. Appl. No. 14/113,649.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Printout from Internet www.ehow.com explaining how to choose a spray gun and stating in item 2 "Nozzle sizes vary between about 1 mm and 2 mm.", printed Sep. 7, 2012.
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012.
Printout from Internet of pages from brochure of Walther Pilot showing nozzle sizes for spray guns ranging from 0.3 mm to 2.5 mm, dated 2007.
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012.
Printout from Internet of p. 28 from current 3Mtm brochure showing Tip/Nozzle/Air Cap Selection Guide with nozzle sizes from 0.5 mm to 3.0 mm.
Decision by EPO regarding opposition proceedings to revoke patent No. 99926841.0-2425/ 1108476, corresponding to '387 patent, 2012.
SATA News Publication Dan-Am Jul.-Sep. 1996.
SATA News Publication Dan-Am Oct.-Dec. 1996.
SATA News Publication Dan-Am Apr.-Jun. 1998.
Dan-Am SATA Catalog 6 for spray guns 1991.
Dan-Am SATA Catalog 8 for spray guns 1994.
Dan-Am Catalog 6—51pp published 1991.
Japanese Industrial Standards B 9809 English translation, 1992.
Japanese Industrial Standards B 9809 revised Mar. 1, 1991.
SATA News, vol. 21, 2009.
Collision Hub TV Document (image from video clip) printed Oct. 9, 2013.
MyRieIsMe.com document from press release printed Oct. 9, 2013.
How to set Air pressure, Utube screenshot printed Oct. 9, 2013.
Ohio EPA Letty to Tony Larimer, response to letter dated Aug. 2006.
Pinahs Ben-Tzvi et al, A conceptual design . . . , Mechatrronics 17 (2007) p. 1-13.
On line ad from Amazon.com printed Oct. 14, 2013.
Rone et al, MEMS-Baed Microdroplet Generation with Integrated Sensing, COMSOL, 2011.
Response filed Oct. 6, 2015 to Notice of Non-Compliant Amendment for U.S. Appl. No. 13/698,417.

(56) References Cited

OTHER PUBLICATIONS

Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
Restriction Requirement Office Action dated Apr. 17, 2017 for U.S. Appl. No. 14/815,210.
Notice of Allowance dated Apr. 10, 2017 for U.S. Appl. No. 29/579,824.
Response to Final Office Action filed May 9, 2017 in U.S. Appl. No. 13/698,417.
Response to Office Action filed May 17, 2017 in U.S. Appl. No. 14/113,649.
Office Action from U.S. Appl. No. 15/143,698 dated Jan. 5, 2017.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Response restriction requirement filed May 23, 2016 for Design U.S. Appl. No. 29/516,082.
Final OA in U.S. Appl. No. 14/113,649 dated Jun. 22, 2017.
Response filed in U.S. Appl. No. 15/143,698 dated Jul. 3, 2017.
International Search Report dated Aug. 31, 2016 for PCT/EP2016/061057 filed May 18, 2016.
Written Opinion for PCT/EP2016/061057 filed May 18, 2016.
International Search Report dated Jul. 14, 2016 for International Application No. PCT/EP2016/000809, filed May 17, 2016.
Written Opinion for International Application No. PCT/EP2016/000809, filed May 17, 2016.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am Apr. 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am Apr. 12, 2017]; English translation of full brochure attached.
Amendments submitted to European Patent Office dated Dec. 3, 2017 for Application No. EP16203544 (with Englsh translation of chart on p. 3).
German Search Report for Application No. 10 2016 009 957.7 dated Apr. 21, 2017.
German Search Report dated Apr. 21, 2017 for application No. 10 2016 009 957.7.
Written Opinion dated Sep. 8, 2016 for International Application No. PCT/EP2016/061057 filed May 18, 2016.
20180522 Final Office Action for U.S. Appl. No. 14/113,649.
U.S. Appl. No. 14/815,210 Office Action dated Apr. 3, 2018.
U.S. Appl. No. 14/113,649 Response filed Mar. 3, 2018.
German Search Report dated Apr. 10, 2018 for Application No. 10 2017 118 599.2.
Office Action, dated Jan. 15, 2019, for U.S. Appl. No. 15/679,533.
Office Action, dated Jan. 15, 2019, for U.S. Appl. No. 15/679,461.
Response to Final Office Action dated Aug. 22, 2018 for U.S. Appl. No. 14/113,649.
European Search Report dated Jan. 24, 2018 for Application No. 17186905.
Response to Election of Species Requirement and Amendment filed Oct. 15, 2018 from U.S. Appl. No. 15/679,482.
Chinese Search Report dated Jul. 18, 2018 for Application No. 2014103745834 filed Jul. 31, 2014.
DesignView of CN302452159 registered Jun. 5, 2013, printed Oct. 18, 2018.
Restriction Requirement Office Action dated Aug. 28, 2018 in U.S. Appl. No. 15/679,533.
Restriction Requirement Office Action dated Aug. 28, 2018 in U.S. Appl. No. 15/679,461.
Notice of Allowance dated Sep. 14, 2018 in U.S. Appl. No. 29/618,945.
Notice of Allowance dated Sep. 14, 2018 in U.S. Appl. No. 14/113,649.
Office Action, dated Jan. 9, 2019, for U.S. Appl. No. 15/679,482.
Restriction Requirement dated Mar. 18, 2019, for U.S. Appl. No. 29/596,869.
Japanese Office Action dated Sep. 25, 2019 for Japanese Publication No. 2015-149405, 4 pages.
Response to Office Action dated Apr. 5, 2019 for U.S. Appl. No. 15/679,461 (29 pages).
Response to Office Action dated Apr. 9, 2019 for U.S. Appl. No. 15/679,533 (22 pages).
Response filed May 28, 2019 for U.S. Appl. No. 15/379,972.
Final Office Action for U.S. Appl. No. 15/679,461 dated Jun. 11, 2019.
Final Office Action for U.S. Appl. No. 15/679,533 dated Jul. 12, 2019.
RCE Reply filed Oct. 11, 2019 for U.S. Appl. No. 15/679,461.
Search Report dated Feb. 22, 2019 for German Patent Application No. 10 2018 118 738.6.
Search Report dated Feb. 8, 2019 for German Patent Application No. 10 2018 118 737.8.
Notice of Allowance dated Jul. 1, 2019 for U.S. Appl. No. 15/379,972.
Notice of Allowance dated Jul. 9, 2019 for U.S. Appl. No. 15/679,482.
Office Action dated Jan. 25, 2019 for U.S. Appl. No. 15/379,972.
Response to Restriction Requirement filed Oct. 29, 2019 for U.S. Appl. No. 15/575,549.
German Search Report dated Mar. 18, 2016 for Application No. 20 2015 003 664.3, 5 pages.
Chinese Search Report dated Feb. 21, 2019 for Application No. 2016800293781, 3 pages.
European Search Report dated Feb. 21, 2020 for Application No. 19183382.1.
Response dated Feb. 19, 2020 for U.S. Appl. No. 15/575,549.
European Search Report, dated Jan. 20, 2020, for European Application No. 19183380.
Final Office Action dated Feb. 27, 2020 for U.S. Appl. No. 15/575,549.
Office Action, dated Nov. 20, 2019, for U.S. Appl. No. 15/575,549 2 pages.

* cited by examiner

SPRAY GUN MANUFACTURING METHOD, SPRAY GUN, SPRAY GUN BODY AND COVER

FIELD OF THE INVENTION

The present invention relates to a spray gun body manufacturing method, a spray gun body, and a cover for a digital pressure measurement device, which cover has an edge of part of a spray gun.

BACKGROUND

The spray gun is a tool that is commonly used in industry, which can for example spray coatings onto article surfaces, e.g. furniture, machinery and especially vehicles.

Moreover, as technology has progressed, a spray gun 1 with a digital pressure measurement device 31 provided on a handgrip 21 has appeared. FIG. 2 shows a spray gun 1 with a digital pressure measurement device 31 provided on a handgrip 21. Compared with a spray gun that is not provided with a digital pressure measurement device (as shown in FIG. 1), the handgrip 21 of the spray gun 1 provided with the digital pressure measurement device 31 is wider, so that the digital pressure measurement device has enough space in the handgrip. This has given rise to a new technical problem.

A spray gun manufacturer must produce two different types of spray gun body; one type has a wider handgrip (digital type), while the other type has a smaller handgrip (standard type). As a result, the manufacturer requires two different types of forging tool or casting tool. These tools are very expensive, leading to high costs. Furthermore, before producing spray gun bodies, the manufacturer must know how many standard spray guns and how many digital spray guns it requires. In addition, the spray gun user must accustom himself to two different types of spray gun handgrip. If a customer is accustomed to using a standard spray gun for work, and wishes to switch to a digital spray gun, he must first become familiar with the digital spray gun, as the digital spray gun is placed differently in the hand. Moreover, since the handgrip of the digital spray gun is very wide, the user must spread his hand very wide when gripping the spray gun in his hand. When the user needs to work with the spray gun for a long period of time, this is tiring for the user.

SUMMARY OF THE INVENTION

A manufacturing method for a spray gun is disclosed, which method allows the same tools (especially casting or forging tools) to be used to produce digital spray guns and standard spray guns; this makes the manufacturing method cheaper and more flexible.

Also disclosed is a body of a spray gun, by means of which spray gun a digital handgrip and a standard handgrip have the same width.

Further disclosed is a spray gun by means of which a digital handgrip and a standard handgrip have the same width.

In addition, a cover for a digital pressure measurement device is disclosed, which cover has a partial edge of a spray gun (in particular a handgrip of a spray gun body).

According to one aspect of the present invention, a method for manufacturing a spray gun is provided, comprising a step of forming a spray gun body. In the step of forming the spray gun body, a bearing part is formed on a side of the spray gun body, with a surface of the bearing part being lower than another surface of the side of the spray gun body, and a partial edge of the bearing part corresponding to a partial edge of the spray gun body.

Preferably, the method further comprises covering the bearing part with a cover, wherein a partial edge of the cover corresponds to the partial edge of the spray gun body.

Preferably, the bearing part is formed on a side of a handgrip of the spray gun body.

Preferably, the method further comprises a step of forming a slot in the bearing part, to hold a digital pressure measurement device.

Preferably, a digital pressure measurement device is formed on the cover.

Preferably, the cover and the spray gun body form a shadow gap.

Preferably, the shadow gap is formed by a step part close to an edge of the cover.

Preferably, the shadow gap is formed by a step part close to an edge of the spray gun body.

Preferably, the shadow gap is formed simultaneously by a step part close to an edge of the cover and a step part close to an edge of the spray gun body.

Preferably, the cover can be removably attached to the spray gun body by means of at least one projection and at least one corresponding hole.

Preferably, the cover has two projections, and the spray gun body has two corresponding holes.

Preferably, the spray gun body has two projections, and the cover has two corresponding holes.

Preferably, the cover has one projection and one corresponding hole, while the spray gun body has one projection and one corresponding hole.

Preferably, the cover has at least one slot.

Preferably, the cover has a window arranged in the slot.

Preferably, the window is covered by a transparent protective plate.

According to another aspect of the present invention, a method for manufacturing a spray gun with a digital pressure measurement device attached is provided, the method comprising a step of manufacturing a spray gun body without a digital pressure measurement device.

Preferably, the method further comprises forming a bearing part on a side of the spray gun body by cutting; a surface of the bearing part is lower than another surface of the side of the spray gun body.

Preferably, a partial edge of the bearing part corresponds to a partial edge of the spray gun body.

Preferably, the bearing part is formed on a side of a handgrip of the spray gun body; and a partial edge of the bearing part corresponds to a partial edge of the handgrip of the spray gun body.

Preferably, the method further comprises forming a slot in the bearing part by cutting in order to hold a digital pressure measurement device.

Preferably, the method further comprises placing the digital pressure measurement device in the slot.

Preferably, the method further comprises covering the bearing part with a cover, wherein a partial edge of the cover corresponds to the partial edge of the spray gun body.

According to another aspect of the present invention, a spray gun body is provided, comprising a handgrip, wherein a bearing part is formed on a side of the spray gun body, with a surface of the bearing part being lower than another surface of the spray gun body side, and a partial edge of the bearing part corresponding to a partial edge of the spray gun body.

According to another aspect of the present invention, a spray gun is provided, comprising a spray gun body, wherein a bearing part is formed on a side of the spray gun body, with a surface of the bearing part being lower than another surface of the side of the spray gun body, and a partial edge of the bearing part corresponding to a partial edge of the spray gun body.

According to another aspect of the present invention, a cover for a spray gun is provided, wherein at least a partial edge of the cover corresponds to a partial edge of a spray gun body.

According to yet another aspect of the present invention, a spray gun comprises a frame body defining a recessed bearing surface forming a first portion of a leading edge of a handgrip; a first cover shaped and dimensioned to fit into the recessed bearing surface and to form a second portion of the leading edge of the handgrip, and a side portion of the handgrip; and a second cover shaped and dimensioned to fit into the recessed bearing surface and to form a second portion of the leading edge of the handgrip, and a side portion of the handgrip. The second cover further includes a recess bounded in part by the second portion of the leading edge of the handgrip, the recess sized and dimensioned to at least partially receive a digital pressure measurement device, and a window formed within the side portion of the handgrip that is sized and dimensioned to enable viewing of a display of the digital pressure measurement device when a digital pressure measurement device is received within the recess. The first cover is connectable to the frame body when a digital pressure measurement device is not installed in the spray gun, and the side portion of the handgrip of the first cover does not include a display window. The second cover is connectable to the frame body when a digital pressure measurement device is installed in the spray gun. The exterior dimensions of the handgrip are substantially the same when either the first or second cover is connected to the frame.

DETAILED DESCRIPTION OF EMBODIMENTS OF THE INVENTION

Figure 1:
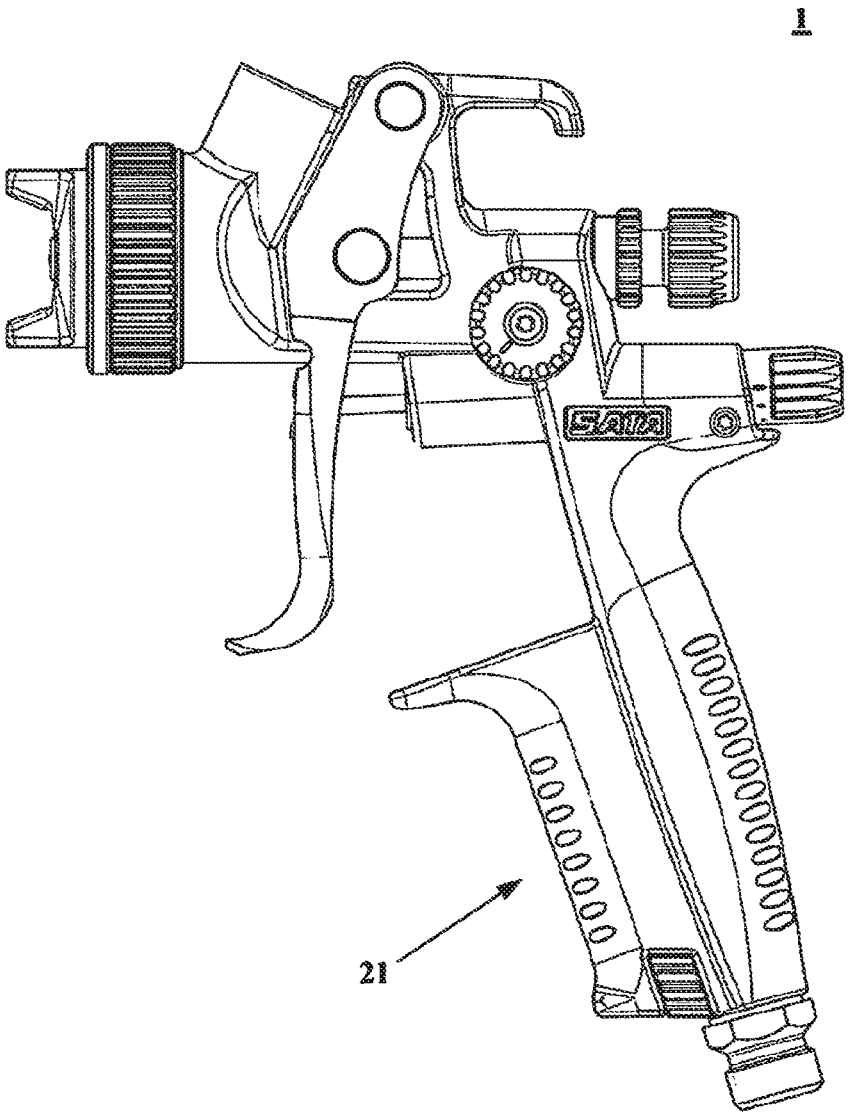
Fig. 1 (Prior Art)
FIG. 1 shows a spray gun in which no digital pressure measurement device is provided on the handgrip in the prior art.
Figure 2:
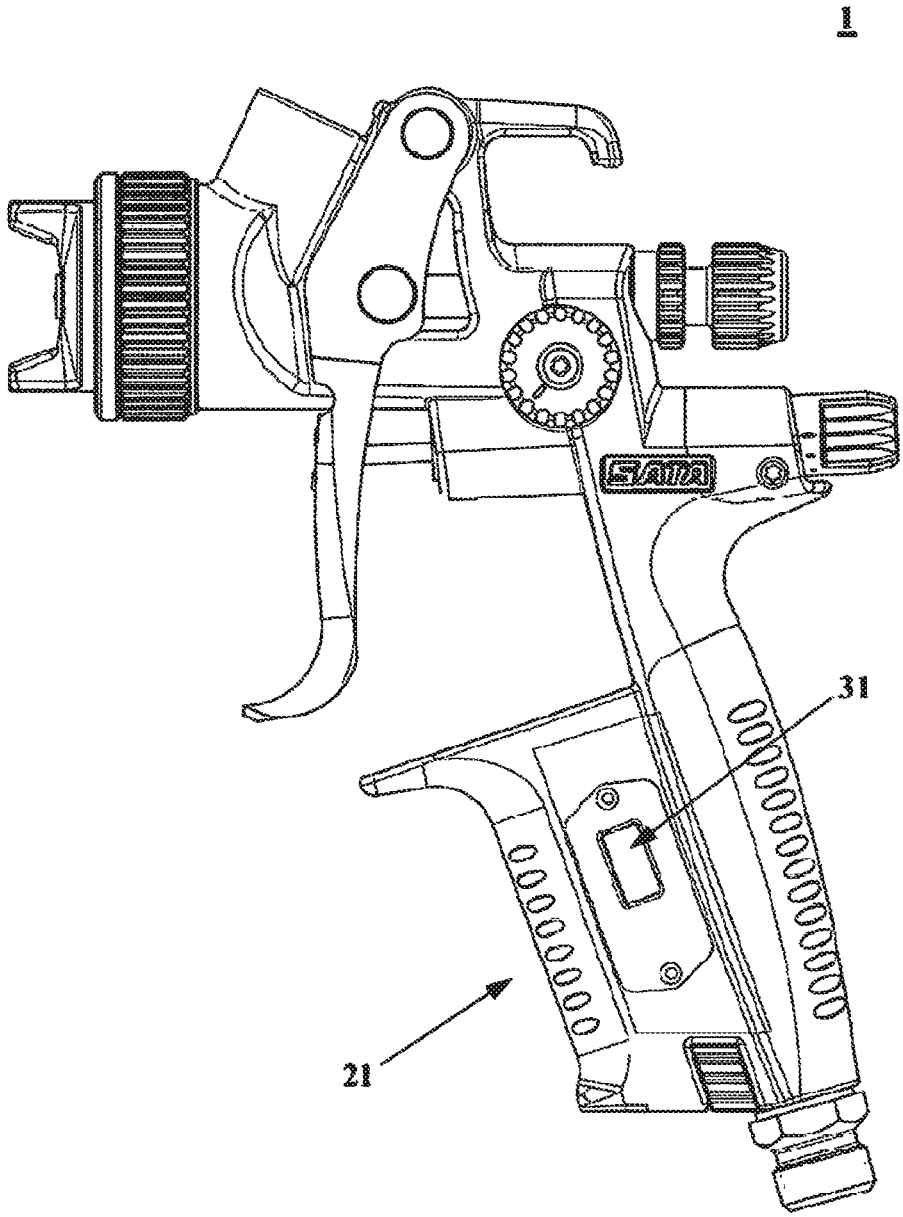
Fig. 2 (Prior Art)
FIG. 2 shows a spray gun in which a digital pressure measurement device is provided on the handgrip in the prior art.

In the following detailed description, the accompanying drawings which form part of this description are referred to, wherein particular embodiments capable of realizing the present invention are shown by way of example. With regard to the drawings, directional terms such as "top", "bottom", "inner" and "outer" are used with reference to the direction of the drawing described. Since the components of the embodiments of the present invention can be placed in many different directions, directional terms are merely used for illustration, without having any limiting meaning. It should be understood that other embodiments may be used, and structural or logic changes may be made on condition that the scope of the present invention is not departed from. Thus, the detailed description below should not be understood as having a limiting meaning, and the present invention shall be defined by the attached claims.

Embodiment One

A method for manufacturing a spray gun according to embodiment one of the present invention is explained with reference to FIG. 3.

Figure 3:
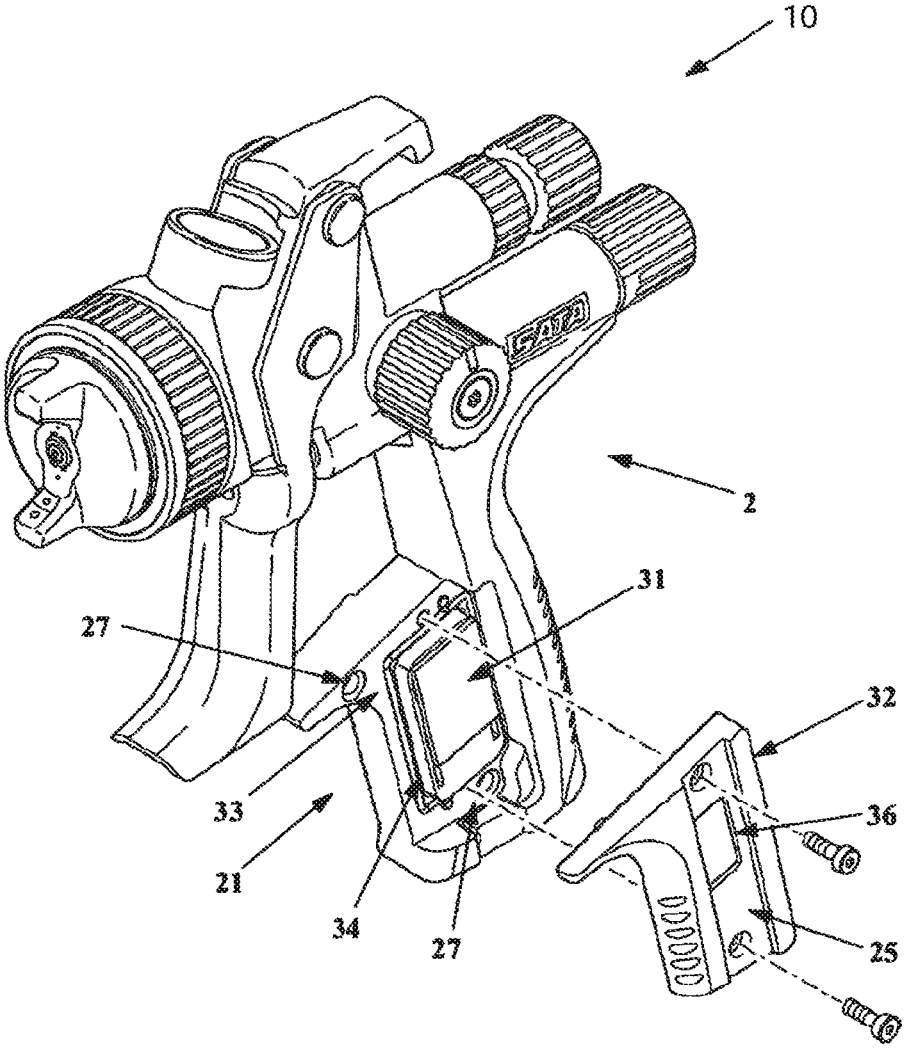
FIG. 3 shows a spray gun body and cover according to embodiment one of the present invention.

As FIG. 3 shows, a body 2 for a spray gun 10 of the present invention is formed by a forging or casting method, with the formed body 2 having, formed on a handgrip 21, a bearing part 33 for bearing a cover 32. Moreover, referring further to FIG. 3, a surface of the bearing part 33 is lower than another surface of the handgrip 21, and a partial edge of the bearing part 33 corresponds to a partial edge of the spray gun body 2. Furthermore, a slot 34 for holding a digital pressure measurement device 31 is formed by cutting in the surface of the bearing part 33 of the body 2. As can be seen by referring to FIG. 6, in at least one region, the slot 34 may run through the entire width (from one side to the other side) of the handgrip. One benefit of such a design is to enable a hole for holding a battery to be reached without removing the cover 32 and the digital pressure measurement device 31. Thus, the hole for holding the battery can be opened by a screw at another of the handgrip, and the battery can be replaced when the hole is empty.

Furthermore, referring further to FIG. 3, the manufacturing method of embodiment one of the present invention also comprises forming the cover 32, for covering the digital pressure measurement device 31. Referring to FIG. 3, a partial edge of the cover 32 corresponds to that partial edge of the bearing part 33 which corresponds to a partial edge of the handgrip 21. That is, once the cover 32 has been installed on the bearing part 33, a partial edge of the cover 32 and a partial edge of the bearing part 33 coincide, together forming a partial edge of the handgrip 21. In the prior art, a cover of the digital pressure measurement device is located in a middle part of the spray gun handgrip, and surrounded by the handgrip, thereby being isolated from the edge of the handgrip. Thus, a frame or edge is needed to surround the cover for the digital pressure measurement device, and an edge of the spray gun handgrip is needed. These two edges both need space, so the handgrip must be made wider from front to back (relative to a spray gun with no digital pressure measurement device) in order to provide enough space. By way of the present invention, the edge of the cover for the digital pressure measurement device is the same as the edge of the handgrip. Thus, a part of the edge of the handgrip of the spray gun 10 is integrally formed in the cover 32, so that there is no need for an additional outer edge formed by the spray gun body. Thus, the space needed for an outer edge is saved. Thus, if a digital pressure measurement device is arranged in the spray gun handgrip, the handgrip can be manufactured with a smaller size (see FIG. 4).

Figure 4:
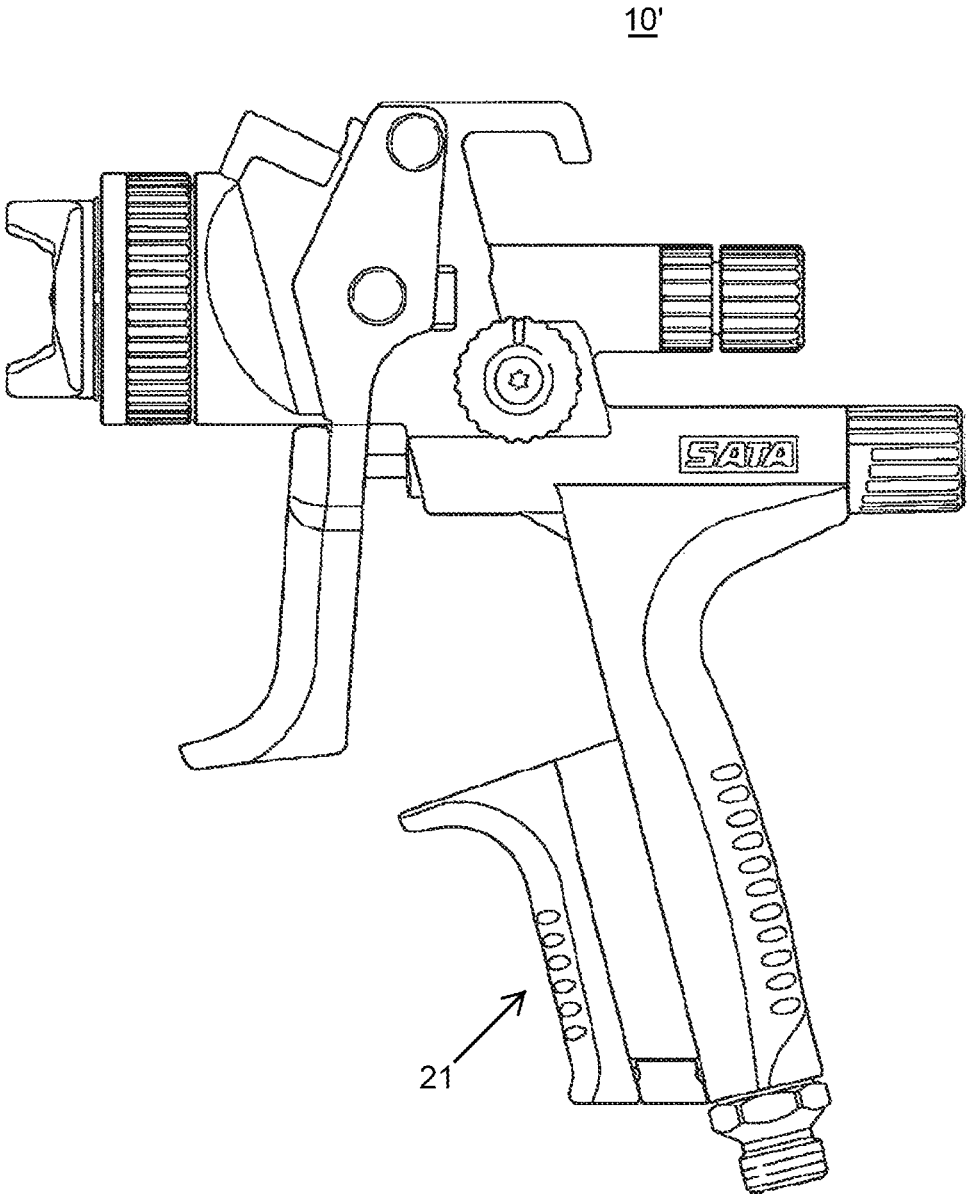
FIG. 4 shows a spray gun in which no digital pressure measurement device is provided according to the present invention.
Figure 5:
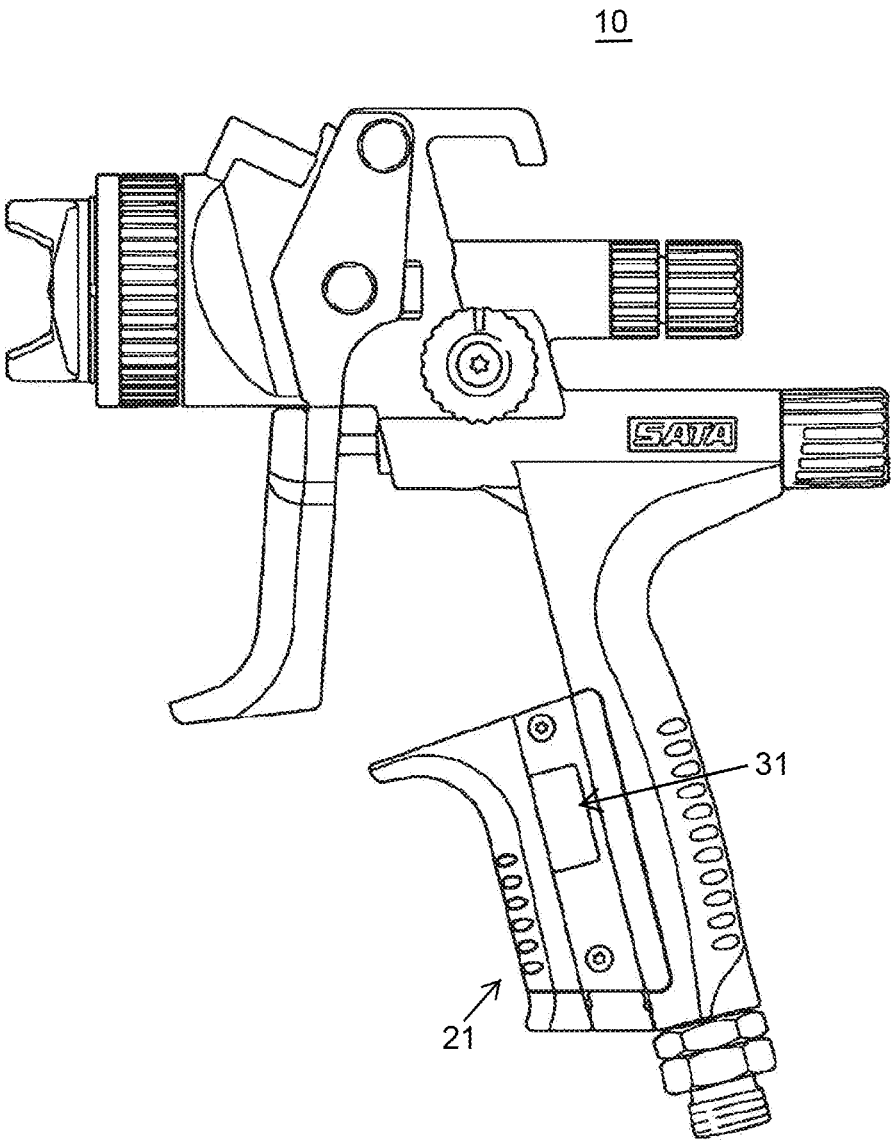
FIG. 5 shows a spray gun in which a digital pressure measurement device is provided according to the present invention.

Furthermore, since the spray gun handgrip provided with a digital pressure measurement device can be manufactured with a smaller size, the method of embodiment one only needs to produce one type of spray gun body, which can then be used for standard spray guns 10' and digital spray guns 10 (see FIGS. 4 and 5). In the process according to the present invention, a manufacturer can first form standard spray gun bodies with intact handgrips, then decide how many spray gun bodies for use in digital spray guns it needs to then manufacture. Holes and slots are cut in these spray gun bodies, to enable them to receive components for a digital pressure measurement device.

Moreover, since a digital spray gun of a width equal to that of a standard spray gun can be manufactured, a user does not need to accustom himself to two different types of spray gun handgrip, therefore the user experience is also enhanced.

Moreover, preferably, referring further to FIG. 3, a slot 25 is provided in the cover 32, and a window 36 is provided in the slot 25, the window being covered by a transparent protective plate. Due to the presence of the slot, the position of the protective plate is further lowered relative to the outer surface of the cover, thereby further protecting the protective plate from impacts from other objects. In addition, the slot can also achieve the objective of saving material. Moreover, the provision of the slot enables the handgrip to be more ergonomic. Since the user's fingers will bend at the front edge of the handgrip 21 when the user grips the handgrip, the user's fingers will wrap round the front edge of the handgrip 21. Since the slot 25 is provided on the handgrip, protruding parts of the user's fingers can be laid in the slot 25 when the user's fingers have wrapped round the front edge of the handgrip 21, thereby preventing the user's fingers from being squeezed with the user's palm after wrapping round the handgrip front edge. Thus the comfort and stability of gripping are enhanced. The slot 25 may also be formed on another side of the spray gun and may also be formed on the handgrip of a spray gun with no digital pressure measurement device.

Furthermore, preferably, referring further to FIG. 3, the cover 32 covers the digital pressure measuring gauge 31 installed on the handgrip 21. The slot 25 is disposed in the cover 32, and a window 33 is provided in the slot 25, the window being covered by a transparent protective plate; the transparent protective plate may for example be bonded on the inside of the window.

Embodiment Two

Embodiment two of the present invention is explained with reference to FIG. 6.

All other technical features of embodiment two of the present invention are the same as in embodiment one, so are not repeated here. Embodiment two differs from embodiment one in that the digital pressure measurement device 31 is formed in the cover 32. The digital pressure measurement device 31 is installed in the handgrip of spray gun 100 by installing the cover 32 on the bearing part 33 of the handgrip 21.

Figure 6:
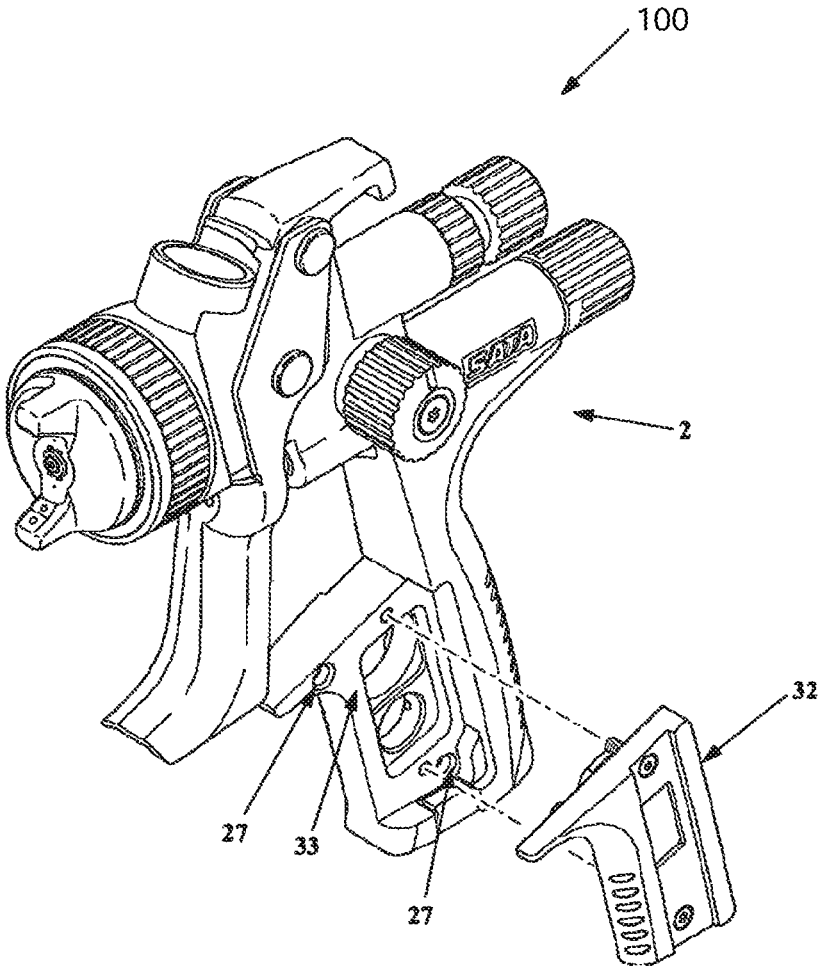
FIG. 6 shows a spray gun body and cover according to embodiment two of the present invention.

As shown in FIG. 6 and mentioned above, the slot in the bearing part may run through the entire width (from one side to the other side) of the handgrip, so that a hole holding a battery is accessible on the other side of the handgrip. This through-running slot is preferably a drilled hole. A blind hole may be provided beside and separate from the through-running drilled hole, so as to be used for holding a pressure sensor. The blind hole is connected to a gas passage in the spray gun, so that the pressure sensor can measure the pressure in the gas passage. Above the drilled hole, a substantially rectangular slot may be formed for holding a circuit board having a display of the digital pressure measurement device.

Embodiment Three

Embodiment three of the present invention is explained below with reference to FIG. 7.

Information about all other technical features of embodiment three of the present invention can be found by referring to embodiment one and embodiment two, so is not repeated.

Figure 7A:
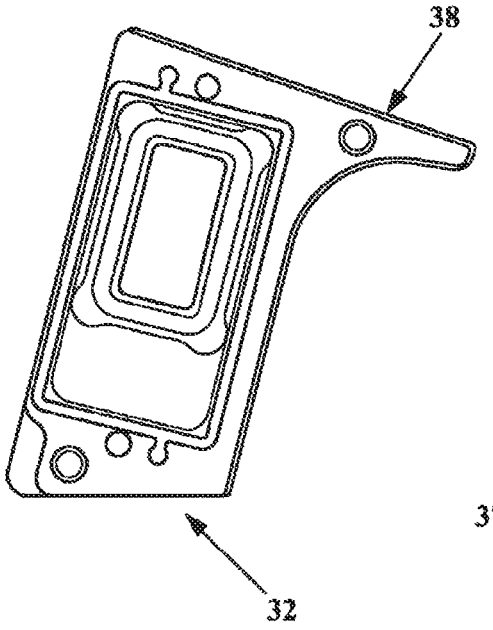
FIG. 7A shows a front view and FIG. 7B shows perspective view of a cover according to embodiment three of the present invention.
Figure 7B:
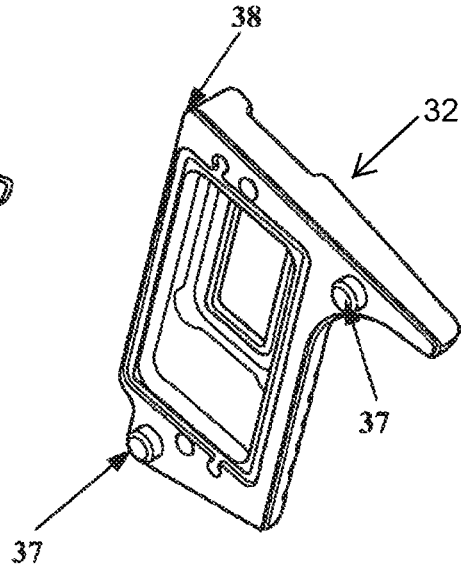

Referring to FIGS. 7A and 7B, the cover 32 has at least one positioning or retaining projection 37, and the bearing part 33 has a hole 27 (FIGS. 3 and 6) for receiving the projection 37; the cover can be removably attached to the spray gun body by means of the at least one projection and the at least one corresponding hole. Thus, if the spray gun falls and the cover strikes the floor, the impact force will not be completely guided to a screw for fixing the cover to the spray gun body; rather, most of the impact force is absorbed by the projection, thereby protecting the screw. The projection can be manufactured to be thicker than the screw, and therefore more sturdy and durable. Alternatively, the spray gun body has a projection, while the cover has a corresponding hole.

Preferably, there are two of said projections.

As can be seen in FIGS. 7A and 7B, the cover 32 also has a slot which holds the digital pressure measurement device. Thus, it is by no means the case that the entire device must be included in the handgrip; it can be sandwiched between the handgrip and the cover and thereby extend into the handgrip and the cover. Thus, the handgrip can be made thinner.

A sealing ring with an attached fixing element is provided in the cover, in order to seal the digital pressure measurement device so it is isolated from the external environment, and pollution by dust, solvents or spray paint is thereby avoided.

Embodiment Four

Figure 8:
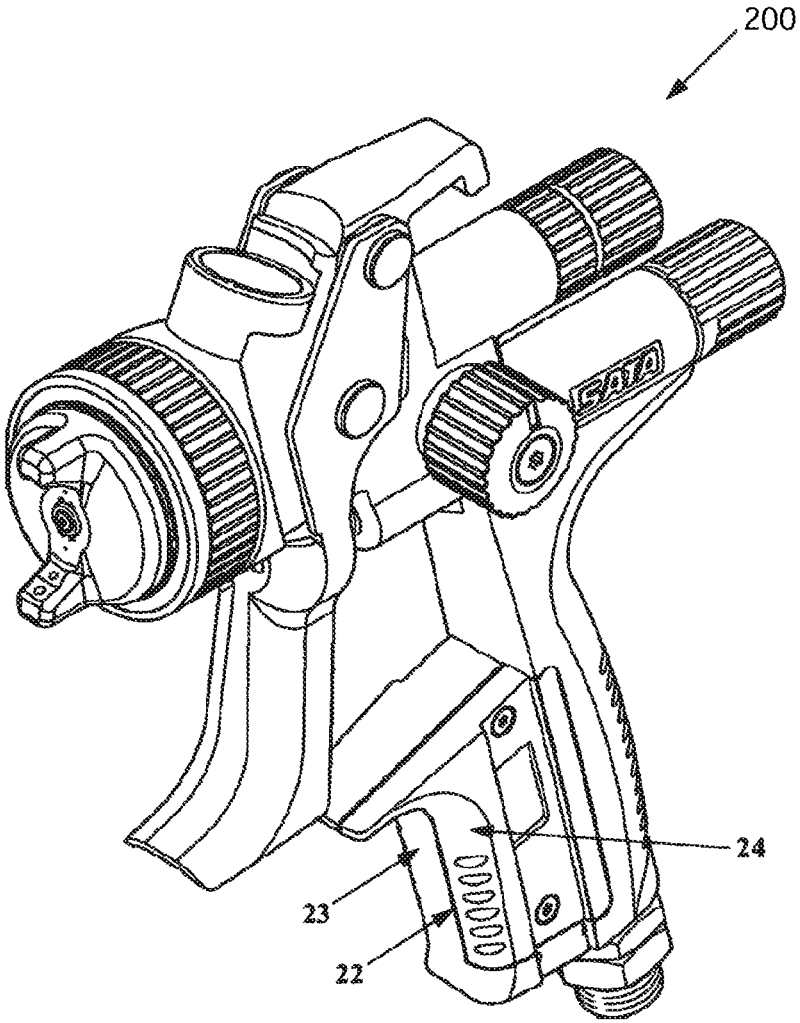
FIG. 8 shows a spray gun according to embodiment four of the present invention.

FIG. 8 shows a fourth embodiment of a spray gun having a digital pressure measurement device according to the present invention.

FIG. 8 shows a spray gun having a shadow gap of the present invention. As FIG. 8 shows, the spray gun 200 has a shadow gap 22, which maintains a certain distance between a surface 23 of the spray gun body and a surface of the cover 24 of the digital pressure measurement device, thereby concealing the error allowed during manufacture, eliminating the need for millimetre-scale precision processing, and reducing the gripping discomfort which arises when the edges of surfaces installed side by side are not flush with each other.

Furthermore, the shadow gap may be formed by a smaller step part 38 close to an edge of the cover 32 of the digital pressure measurement device, as FIGS. 7A and 7B show. The cover 32 forms an edge of the spray gun, and the cover 32 has at least one shadow gap; when a surface having a shadow gap is installed side by side with another surface, the shadow gap can give rise to a boundary part for permitting a certain error, thereby eliminating the need for millimetre-scale precision processing.

In addition, the shadow gap may also be formed by a smaller step part close to an outer edge of the spray gun body to be fitted with the cover, or formed simultaneously by a smaller step part close to an edge of the cover of the digital pressure measurement device and a smaller step part close to an outer edge of the spray gun body to be fitted with the cover.

In addition, the shadow gap may also be formed by another form besides a step part.

The above embodiments are merely preferred embodiments of the present invention, which are not intended to limit it. To those skilled in the art, various changes and alterations to the present invention are possible. Any amendments, equivalent substitutions or improvements etc. made within the spirit and principles of the present invention should be included in the scope of protection thereof.

What is claimed is:

1. A method of manufacturing a spray gun, comprising:

forming a spray gun body with a complete handgrip including opposed leading and trailing edge surfaces and opposed side surfaces, the complete handgrip having first external dimensions such that the complete handgrip has a first grip size for gripping by a user of the spray gun;

cutting one of the side surfaces to remove a portion of the side surface and a portion of the leading edge surface to form an incomplete handgrip having a recessed bearing surface, with an upper surface of the recessed bearing surface being lower than the side surface before cutting; and covering the bearing surface with a cover that is shaped and dimensioned to cover the removed portion of the side surface and leading edge surface to thereby form a modified complete handgrip having second external dimensions such that the modified complete handgrip has a second grip size for gripping by a user of the spray gun;

wherein the second external dimensions are substantially the same as the first external dimensions and the second grip size is substantially the same as the first grip size.

2. The method of claim 1, wherein the cover includes a window opening through which a display can be viewed.

3. The method of manufacturing a spray gun according to claim 2, wherein the display is associated with a digital pressure measurement device attached to the cover.

4. The method of manufacturing a spray gun according to claim 1, wherein the cover and the incomplete handgrip form a shadow gap therebetween.

5. The method of manufacturing a spray gun according to claim 4, wherein the shadow gap is formed by a step part close to an edge of the cover.

6. The method of manufacturing a spray gun according to claim 1, wherein the cover has at least one slot that is shaped and dimensioned to receive a portion of a pressure measurement device.

7. The method of manufacturing a spray gun according to claim 6, wherein the cover has a window opening arranged adjacent to the slot.

8. The method of manufacturing a spray gun according to claim 7, wherein the window is covered by a transparent protective plate.

9. The method of manufacturing a spray gun according to claim 1, wherein the cover and the recessed bearing surface together form at least one mutually engaging positioning projection and corresponding hole for receiving the positioning projection.

10. The method of manufacturing a spray gun according to claim 1, wherein one of the cover and the recessed bearing surface includes at least one positioning or retaining projection, and the other of the cover and the recessed bearing surface includes at least one corresponding hole for receiving the positioning or retaining projection.

11. The method of manufacturing a spray gun according to claim 1, further comprising:

inserting a pressure measurement device into the incomplete handgrip and positioning the pressure measurement device onto the recessed bearing surface.

12. The method of manufacturing a spray gun according to claim 11, wherein the pressure measurement device is electronic and includes visible indicia indicating working pressure of the spray gun, the indicia visible through an opening in the attached cover.

13. The method of manufacturing a spray gun according to claim 12, where the cover includes a transparent window.

* * * * *